US008668531B2

(12) United States Patent
Yamaguchi et al.

(10) Patent No.: US 8,668,531 B2
(45) Date of Patent: Mar. 11, 2014

(54) TERMINAL

(75) Inventors: Yasuhiro Yamaguchi, Shizuoka (JP); Hajime Kato, Shizuoka (JP); Yuichiro Matsumoto, Shizuoka (JP); Masayuki Kataoka, Shizuoka (JP); Tsuyoshi Mizushima, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/378,005

(22) PCT Filed: Jun. 15, 2010

(86) PCT No.: PCT/JP2010/060113

§ 371 (c)(1),
(2), (4) Date: Dec. 13, 2011

(87) PCT Pub. No.: WO2011/001821

PCT Pub. Date: Jan. 6, 2011

(65) Prior Publication Data

US 2012/0108113 A1 May 3, 2012

(30) Foreign Application Priority Data

Jul. 3, 2009 (JP) ..... 2009-158401
Aug. 10, 2009 (JP) ..... 2009-185659

(51) Int. Cl.
*H01R 13/187* (2006.01)

(52) U.S. Cl.
USPC ..... 439/845; 439/843

(58) Field of Classification Search
USPC ..... 439/842–858
See application file for complete search history.

(56) References Cited

U.S. PATENT DOCUMENTS 4,456,325 A * 6/1984 Benz ..... 439/816
4,753,616 A * 6/1988 Molitor ..... 439/787

(Continued)

FOREIGN PATENT DOCUMENTS

JP S51-8453 U 3/1976
JP S552-105968 U 8/1977

(Continued)

OTHER PUBLICATIONS

International Search Report and Written Opinion for PCT/JP2010/060113 issued Aug. 10, 2010.

(Continued)

*Primary Examiner* — Ross Gushi
(74) *Attorney, Agent, or Firm* — Edwards Wildman Palmer LLP

(57) ABSTRACT

A terminal 1 which maintains electrical connectivity between a mating terminal and contact spring pieces, reduce size and firmly fixes the contact spring pieces at a terminal main body, includes the conductive, rectangular tube-shaped terminal main body 3 into which the mating terminal 2 is inserted, the plurality of one conductive contact spring pieces 18 extending from one wall 5 to the other wall 6 of the terminal main body and tilted relative to a mating terminal insertion direction, and a plurality of the other conductive contact spring pieces 19 extending from the other wall to the one wall and tilted relative to the insertion direction. The one and the other contact spring pieces 78, 79 are arranged alternatively along the insertion direction. The terminal main body includes a spring member 4 having one and the other basal plate portions 15, 16, a connecting plate portion 17 connecting the respective basal plate portions, and an engagement portion 20 at the connecting plate portion which engages with a locking portion 11 of the terminal main body 3.

20 Claims, 7 Drawing Sheets

(56) References Cited

U.S. PATENT DOCUMENTS

| | | | | |
|---|---|---|---|---|
| 4,934,965 | A * | 6/1990 | Buddrus et al. | 439/845 |
| 5,261,840 | A * | 11/1993 | Benz | 439/843 |
| 5,342,226 | A * | 8/1994 | Hayes et al. | 439/845 |
| 5,433,630 | A | 7/1995 | Inaba et al. | |
| 5,588,884 | A * | 12/1996 | Rudoy et al. | 439/845 |
| 5,911,605 | A * | 6/1999 | Wooldridge et al. | 439/790 |
| 6,062,919 | A | 5/2000 | Trafton | |
| 6,276,960 | B1 * | 8/2001 | Schaefer et al. | 439/522 |
| 6,287,156 | B1 * | 9/2001 | Swan et al. | 439/845 |
| 6,416,340 | B2 * | 7/2002 | Schaefer et al. | 439/224 |
| 6,485,337 | B2 * | 11/2002 | Hsieh | 439/845 |
| 6,672,911 | B2 * | 1/2004 | Zhao et al. | 439/845 |
| 6,692,316 | B2 * | 2/2004 | Hsieh et al. | 439/845 |
| 7,150,660 | B2 * | 12/2006 | Allgood et al. | 439/845 |
| 7,241,189 | B2 * | 7/2007 | Mohs et al. | 439/845 |
| 7,775,840 | B2 * | 8/2010 | Matsumoto et al. | 439/843 |
| 7,789,720 | B2 * | 9/2010 | Zinn | 439/845 |
| 7,837,521 | B2 * | 11/2010 | Kato et al. | 439/843 |
| 7,845,993 | B2 * | 12/2010 | Falchetti | 439/843 |
| 8,038,488 | B2 * | 10/2011 | Mukuno | 439/845 |
| 8,128,441 | B2 * | 3/2012 | Mukuno | 439/845 |
| 2001/0039145 | A1 | 11/2001 | Schaefer et al. | |
| 2002/0025732 | A1 * | 2/2002 | Hsieh | 439/845 |
| 2003/0060090 | A1 * | 3/2003 | Allgood et al. | 439/845 |
| 2006/0014442 | A1 * | 1/2006 | Allgood et al. | 439/843 |
| 2007/0066152 | A1 * | 3/2007 | Mohs et al. | 439/843 |
| 2007/0218736 | A1 | 9/2007 | Takizawa et al. | |
| 2009/0029605 | A1 * | 1/2009 | Matsumoto et al. | 439/843 |
| 2010/0151748 | A1 * | 6/2010 | Kato et al. | 439/834 |
| 2011/0045712 | A1 * | 2/2011 | Mukuno | 439/845 |
| 2012/0108113 | A1 * | 5/2012 | Yamaguchi et al. | 439/842 |
| 2012/0156947 | A1 * | 6/2012 | Tyler | 439/842 |

FOREIGN PATENT DOCUMENTS

| | | | |
|---|---|---|---|
| JP | 58-188995 | A | 12/1983 |
| JP | H06-302349 | | 10/1994 |
| JP | 2000-113920 | A | 4/2000 |
| JP | 2004-206911 | A | 7/2004 |
| JP | 2006-012741 | A | 1/2006 |
| JP | 2007-250362 | A | 9/2007 |

OTHER PUBLICATIONS

Japanese Office Action mailed on Jun. 4, 2013 for corresponding Japanese Patent Application No. 2009-158401.

Japanese Office Action mailed on Jul. 2, 2013 for corresponding Japanese Patent Application No. 2009-185659.

The extended European search report dated Oct. 24, 2013 for corresponding European Patent Application No. 10793991.0.

* cited by examiner

TERMINAL

FIELD OF THE INVENTION

The present invention relates to a terminal used in a high current power distribution, the terminal including therein a spring member having a plurality of contact spring pieces and being connected to a mating terminal of an electric wire or a mating terminal of for example a bus bar, a relay or a fuse.

DESCRIPTION OF THE RELATED ART

FIG. 16 shows a conventional terminal according to one embodiment. A terminal 51 includes a terminal main body 54 having a mating-terminal mating portion 52, an electric wire connection portion 53, and a pair of front and rear spring members 55 made of conductive metal and mounted inside the mating-terminal mating portion 52 so as to face each other.

The pair of spring members 55 includes contact spring pieces 57 each formed between a plurality of longitudinal slits 56, and the pair of spring members 55 is fixed by inserting a shoulder portion thereof into an engagement recess 58 of the mating-terminal mating portion 52 and clamping the engagement recess 58 using a tool such as a chisel.

FIG. 17 shows the conventional terminal according to another embodiment. This terminal 61 is provided at an end of a bus bar 62 to be connected to a high current circuit of, for example, an electric motor vehicle. The terminal 61 includes a rectangular tube-like terminal main body 63 and a spring member 64 mounted inside the terminal main body.

The terminal main body 63 includes a projection for a contact provided at an inner face of an upper wall 65 and a bottom wall 66, respectively. The spring member 64 is arranged at the bottom wall 67 so as to face to the projection of the upper wall 65. The spring member 64 includes a plurality of parallely-aligned contact spring pieces 69 projecting upwardly and tilted in a direction from one wall 67 to the other wall 68 of the terminal main body 63. The mating terminal is inserted from a front opening of the terminal main body 63 along the respective contact spring pieces 69 and the projection.

Patent Literature 1: Japanese Patent Publication No. H06-302349 (FIG. 1)

Patent Literature 2: Japanese Patent Publication No. 2007-250362 (FIG. 3)

SUMMARY OF THE INVENTION

Technical Problem

However, for the conventional terminal 51 shown in FIG. 16, there is a problem that since the spring member 55 is required to be clamped with a tool to be fixed to the terminal main body 54, it often causes variation in fixation strength and mounting position of the spring member 55. In addition, there is a problem that when inserting or removing the mating terminal, since the plurality of spring pieces 57 of the spring member 55 simultaneously contacts with the mating terminal, the insertion force and the removal force become great, lowering the workability in inserting or removing the mating terminal. Furthermore, there is also a problem that the pair of front-and-rear spring members 55 causes an increase in size of the mating-terminal mating portion 52 in a thickness direction.

Furthermore, for the conventional terminal 61 shown in FIG. 17, there is a problem that if the spring member 64 is fixed to the terminal main body 63 by a fixing means, the fixing means may be loosened and a gap is produced at the fixing means, causing the displacement or the detachment of the spring member 64. In addition, the displacement of the spring member 64 may cause a deformation of the spring member 64 which leads to a variation in contact pressure of the respective contact spring pieces 69 with respect to the mating terminal, decreasing the electrical connectivity. Furthermore, since the mating terminal is sandwiched between the projection and the spring member 64 and contacted therewith, a force applied to the plate-like mating terminal in the thickness direction may cause a failure in contact between the projection and the mating terminal. Also, when inserting or removing the mating terminal, since the plurality of spring pieces 69 of the spring member 64 simultaneously contacts with the mating terminal, the insertion force and the removal force become great, lowering the workability in insertion or removal of the mating terminal.

Thus, in view of the above-described problems, an object of the present invention is to provide a terminal which can constantly maintain a good electrical connectivity between the mating terminal and the contact spring pieces, in which the insertion and the removal of the mating terminal can be performed with a relatively small force to improve the workability, which can reduce the size thereof in the thickness direction, and which can firmly fix the contact spring pieces at the terminal main body without causing any displacement.

Solution to Problem

In order to achieve the above-described object, a terminal of the present invention according to a first aspect includes: a conductive, rectangular tube-shaped terminal main body into which a mating terminal is inserted; a plurality of one contact spring pieces made of conductive material and projecting in a direction from one wall to the other wall of the terminal main body and tilted with respect to a mating terminal insertion direction; and a plurality of the other contact spring pieces made of conductive material and projecting in a direction from the other wall to the one wall and tilted with respect to the mating terminal insertion direction.

According to the invention described above, each of the one and the other contact spring pieces exerts an equivalent spring force on the mating terminal in a thickness direction of the mating terminal, so that the each of the one and the other contact spring pieces firmly contacts with the mating terminal with equivalent contact pressure and self-aligns the mating terminal in a centripetal manner.

The terminal of the present invention according to a second aspect is the terminal described above, wherein the plurality of one contact spring pieces and the plurality of the other contact spring pieces are arranged to align along the mating terminal insertion direction.

According to the invention described above, during a procedure of inserting the mating terminal, the number of the contact spring pieces contacting with the mating terminal increases gradually, so that the insertion of the mating terminal can be performed smoothly via a small insertion force. Furthermore, during a procedure of removing the mating terminal, the number of the contact spring pieces contacting with the mating terminal decreases gradually, so that the removal of the mating terminal can be performed smoothly.

The terminal of the present invention according to a third aspect is the terminal according to the first or second aspect described above, wherein the one contact spring pieces and the other contact spring pieces are arranged at opposing positions along a thickness direction of the one wall and the other wall.

According to the invention described above, each of the one and the other contact spring pieces facing to each other exerts an equivalent spring force on the mating terminal in the plate thickness direction of the mating terminal, so that each of the one and the other contact spring pieces contacts further firmly with the mating terminal with further equivalent contact pressure, while self-aligning the mating terminal in a centripetal manner.

The terminal of the present invention according to a fourth aspect is the terminal according to the first or second aspect described above, wherein the one contact spring piece and the other contact spring piece are arranged alternatively in a staggered alignment along the mating terminal insertion direction.

According to the invention described above, the one contact spring piece and the other contact spring piece are arranged alternatively in a staggered manner in the mating terminal insertion direction so as not to overlap with respect to each other in a height direction of the terminal main body. Consequently, the height of the terminal can be reduced.

The terminal of the present invention according to a fifth aspect is the terminal according to the first or second aspect described above, wherein the one contact spring piece and the other contact spring piece are arranged at the same position in the mating terminal insertion direction while arranged alternatively in a staggered alignment in the width direction of the wall.

According to the invention described above, the one contact spring piece and the other contact spring piece are arranged alternatively in a staggered manner in the width direction of the terminal main body (i.e. a direction orthogonal to the mating terminal insertion direction and the thickness direction of the mating terminal), so as not to overlap with respect to each other in the height direction of the terminal main body. Consequently, the height of the terminal can be reduced. In this case, compared to arranging alternatively in the staggered manner in the mating terminal insertion direction, the terminal main body is downsized in the mating terminal insertion direction. However, since the terminal main body is likely to broaden in the width direction thereof, it is preferred that each of the one and the other contact spring pieces are partially overlapped in the width direction.

The terminal of the present invention according to a sixth aspect is the terminal according to any one of the first through fifth aspect, further comprising a spring member mounted inside the terminal main body, the spring member including: one basal plate portion and the other basal plate portion both having the one contact spring pieces and the other contact spring pieces, wherein the mating terminal is to be inserted between the one basal plate portion and the other basal plate portion; a connecting plate portion connecting the one basal plate portion and the other basal plate portion; and an engagement portion provided at the connecting plate portion and arranged to engage with a locking portion of the terminal main body.

According to the invention described above, the respective upper and lower (one and the other) basal plates connecting the plurality of contact spring pieces are connected via the right and left connecting plate portions, so that the basal plate portions and the connecting plate portions together form a rectangular frame exhibiting a high rigidity and are, in that frame form, engaged with (fixed to) the terminal main body via the engagement portion and the locking portion. Consequently, during the insertion of the mating terminal, the basal plate portion is prevented from being deformed, and each of the contact spring pieces can firmly contact with the mating terminal via equivalent contact pressure. The engagement portion and the locking portion may be, for example, a projecting piece, a protrusion, an aperture or a recess.

The terminal of the present invention according to a seventh aspect is the terminal according to the sixth aspect, wherein the connecting plate portion is provided plurally such that the pair of the connecting plate portions is arranged at a front end and at a rear end of the basal plate portion in the mating terminal insertion direction, respectively, and wherein a pair of engagement pieces, as the engagement portion, is arranged at a front end and a rear end of the respective pairs of connecting plate portions, respectively, and wherein each of the pairs of engagement pieces engages with each of locking apertures as the locking portion.

According to the invention described above, the upper and lower (one and the other) basal plate portions are connected via each of the front and rear pairs of connecting plate portions, and an opening is provided between the front connecting plate portions and the rear connecting plate portions. Consequently, the upper and lower basal plate portions can be compressed and flexibly deformed in the height direction and in the width direction, facilitating the mounting of the spring member into the terminal main body. In addition, when mounting the spring member into the terminal main body, the engagement piece deforms and inserted into and engaged with the locking aperture, and then the engagement piece restores elastically and abuts on an end face of the locking aperture via a surface contact, thereby exerting a strong locking (fixing) force. In addition, the pair of engagement pieces of the each connecting plate portion abuts on the front and rear end faces of the locking aperture via a surface contact, thereby exerting a strong locking (fixing) force.

The terminal of the present invention according to a eighth aspect is the terminal according to any one of the first and the seventh aspects, wherein one projection and the other projection which allow the insertion of the mating terminal are provided at a front end and a rear end of the terminal main body, wherein the one contact spring pieces and the other contact spring pieces project further inwardly than the one projection and the other projection.

According to the invention described above, when an external force in the vertical direction (the plate thickness direction) is applied to the mating terminal, the mating terminal abuts on the upper and lower projections, thereby further movement of the mating terminal is inhibited. Consequently, a reliable contact between the upper and lower contact spring pieces with the mating terminal can be maintained.

Advantageous Effects of the Invention

According to the terminal described in the first aspect, since the mating terminal is self-aligned in a centripetal manner with respect to the thickness direction of the mating terminal by each of the one and the other contact spring pieces, the respective contact spring pieces firmly contact with the mating terminal with equivalent contact pressure, thereby improving the electrical connectivity. In this case, even if the mating terminal is moved in the thickness direction by an external force, each of the one and the other contact spring pieces follows the movement of the mating terminal and maintains the contact with the mating terminal, thereby improving the electrical connection reliability.

According to the terminal described in the second aspect, when inserting and removing the mating terminal, the number of the contact spring pieces contacting with the mating terminal increases and decreases gradually. As a result, the insertion and the removal of the mating terminal are performed smoothly via a relatively small force with an efficient workability.

According to the terminal described in the third aspect, each of the one and the other contact spring pieces which are arranged opposingly serves to self-align the mating terminal in a centripetal manner. Consequently, each of the one and the other contact spring pieces contacts with the mating terminal even more firmly with further equivalent contact pressure, thereby further improving the electrical connection reliability.

According to the terminal described in the fourth aspect, since the one contact spring piece and the other contact spring piece are arranged alternatively in a staggered manner so as not to overlap with respect to each other in the height direction of the terminal main body, the height of the terminal can be reduced (the terminal can be downsized).

According to the terminal described in the fifth aspect, since the one contact spring piece and the other contact spring piece are arranged alternatively in a staggered manner so as not to overlap with respect to each other in the height direction of the terminal main body, the height of the terminal can be reduced (the terminal can be downsized). In addition, compared with a case of arranging alternatively in the staggered manner in the mating terminal insertion direction, the terminal main body is downsized in the mating terminal insertion direction.

According to the terminal described in the sixth aspect, since the respective basal plate portions and the respective connecting plate portions of the spring member having high rigidity is fixed within the terminal main body, undesirable deformation of the respective basal plate portions during an insertion of the mating terminal can be prevented. Consequently, each of the one and the other contact spring pieces can be firmly contact with the mating terminal with an equivalent contact pressure, thereby improving the electrical connection reliability.

According to the terminal described in the seventh aspect, the respective front-and-rear pairs of connecting plate portions allow the deformation of the upper and lower basal plate portions. Consequently, the spring member can be easily mounted within the terminal main body by flexibly deforming the upper and lower basal plate portions. In addition, the engagement piece can be flexibly deformed and then easily engaged with the locking aperture. Also, the engagement piece engaged with the locking aperture abuts on the end face of the locking aperture via a surface contact, thereby reliably and firmly fixing the spring member to the terminal main body. Consequently, the position of the spring member within the terminal main body can be reliably maintained even if the mating terminal is inserted and removed forcefully. In addition, since the pair of engagement pieces of the each connecting plate portion abuts on the front and rear end faces of the locking aperture via a surface contact, the spring member can be further reliably and firmly fixed to the terminal main body, thereby even more reliably maintaining the position of the spring member within the terminal main body even if the mating terminal is inserted and removed forcefully.

According to the terminal described in the eighth aspect, even if an external force in the vertical direction (the plate thickness direction) is applied to the mating terminal, the mating terminal abuts on the upper and lower projections. Consequently, further movement of the mating terminal can be inhibited, and thus the reliable contact between the upper and lower contact spring pieces with the mating terminal can be maintained, improving the electrical connection reliability.

DESCRIPTION OF EMBODIMENTS

Figure 1:
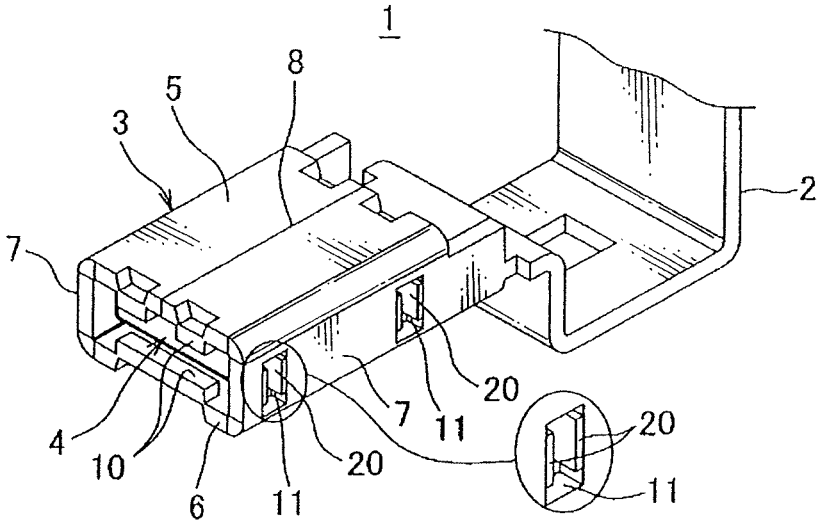
FIG. 1 is a perspective view of a terminal of the present invention according to a first embodiment.
Figure 2:
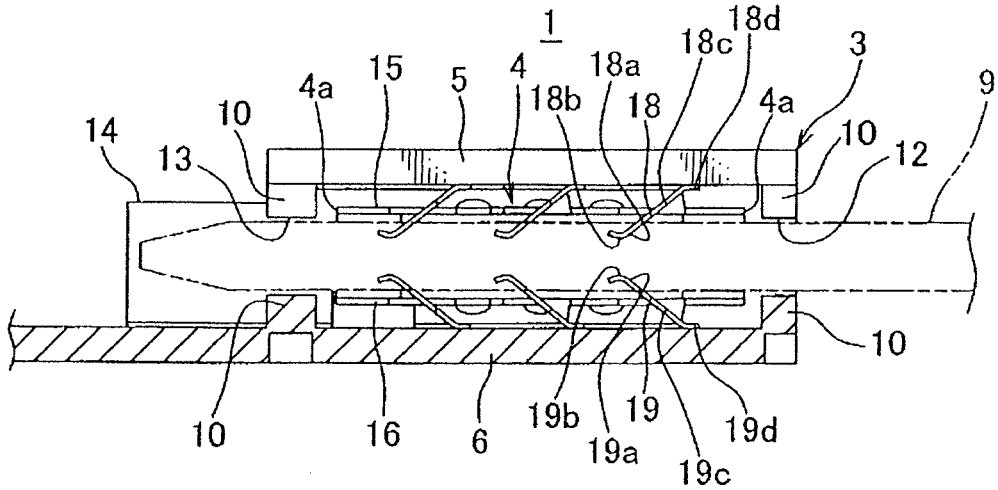
FIG. 2 is a vertical cross section showing a state in which a mating terminal is inserted into the terminal.
Figure 3:
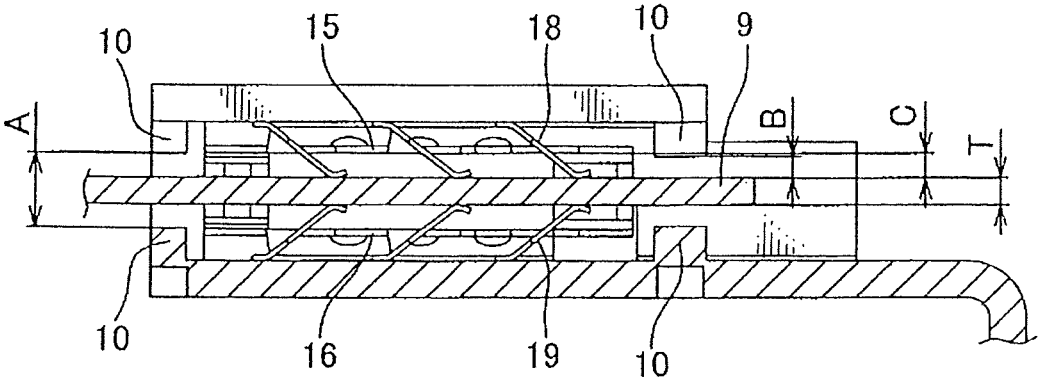
FIG. 3 is a vertical cross sectional view of one embodiment showing a contact between the terminal and the mating terminal.

FIGS. 1 through 3 shows a terminal of the present invention according to a first embodiment.

As shown in FIG. 1, a female-type terminal 1 is constituted of a terminal main body 3 made of a conductive metal formed integrally with a conductive metal bus bar 2, and a spring member 4 made of a conductive metal which is attached and fixed inside the terminal main body 3. A base end portion (not shown) of the bus bar 2 is clamped and connected to a high-voltage unit via a bolt. The terminal main body 3 as a flat, rectangular tube-shaped portion holding the spring member 4 is integrally provide at a tip portion of the bus bar 2.

The terminal main body 3 includes broad and horizontal upper and lower (one and the other) walls 5, 6 as well as narrow and vertical right and left walls 7 which form a peripheral wall of the terminal main body 3. The upper wall 5 is constituted of separate pieces which are jointed along a center line of the upper wall 5 (a separation line is indicated by a reference sign 8). A projection 10 (FIG. 2) which abuts on and contact with a male-type mating terminal 9 (FIG. 2) is provided at a front end and a rear end of the upper and lower walls 5, 6, respectively. A pair of rectangular front and rear locking apertures 11 for the spring member 4 is provided at the right and left walls 7, respectively.

The terminal main body 3 is formed such that the lower wall (bottom wall) 6 is continuous with the bus bar 2 in a same plane, the both side walls 7 extend perpendicularly from both of a right end and a left end of the lower wall 6, and the pair of the upper walls 5 bends inwardly from an upper end of the both side walls 7. The shape of the bus bar 2 may be designed suitably according to the shape of a portion to which the bus bar 2 is connected. The bus bar 2 may be replaced with an electric wire connection portion (not shown) provided at the rear portion of the terminal main body 3.

As shown in FIG. 2, the mating terminal 9 is inserted through the terminal main body 3 from a front opening 12 towards a rear opening 13. The both side walls 7 extend in a rear direction so a rearward extended portion 14 serves to protect a tip portion of the mating terminal 9. A space (indicated by the reference sign A in FIG. 3) between the upper and lower projections 10 at the front end and the rear end of the terminal main body 3 is arranged larger than a plate thickness T of the mating terminal 9. The spring member 4 is mounted between the front and rear projections 10 such that front and rear ends 4*a* of the spring member 4 are spaced apart from an inner face of the projection 10. The projection 10 is formed by pressing by a press (bulging out) the upper and lower walls 5, 6 of the terminal main body 3.

Figure 4:
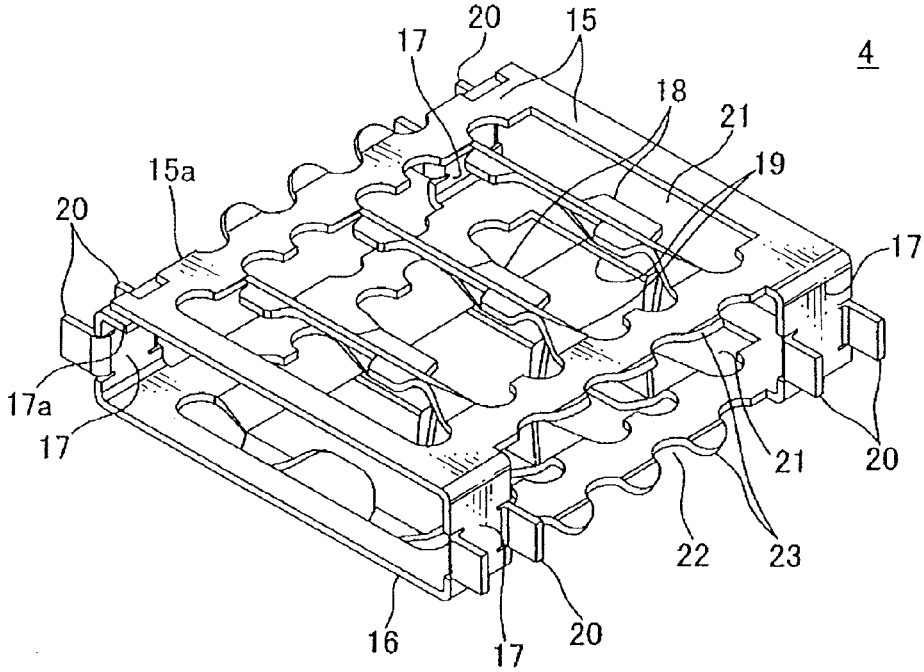
FIG. 4 is a perspective view showing one embodiment of a spring member to be mounted within a terminal main body.

FIG. 4 shows one example of the spring member 4. As shown, the spring member 4 includes broad and horizontal upper and lower (one and the other) basal plate portions 15, 16, a pair of narrow and vertical connecting plate portions 17 which are provided at front and rear ends at the right and left sides (side portions), a plurality of contact spring pieces 18, 19 penetrating vertically through the basal plate portion 15, 16, and a pair of vertical engagement pieces 20 projecting outwardly from a front end and a rear end of the respective connecting plate portions 17.

The plurality of upper and lower (one and the other) contact spring pieces 18, 19 are arranged respectively in parallel across from a front end of the basal plate portions 15, 16 through a rear end of the basal plate portions 15, 16, respectively. The shape and the size of the respective upper and lower contact spring pieces 18, 19 are equivalent to each other well as the spring force thereof. Although the number of the respective contact spring pieces 18, 19 is three in this exemplary embodiment, the number may be two or four, or even one at a minimum, according to a current value to be carried therethrough (the larger the current value, the larger the number of the contact spring pieces 18, 19).

An elongated opening 21 is formed at the basal plate portions 15, 16, respectively, as a result of the formation of the respective contact spring pieces 18, 19 formed by cutting and bending upwardly with a press. A large, rectangular side opening 22 is formed between the connecting plate portions 17 at the front and rear ends, and a plurality of tilted support protrusions 23 are provided adjacent to the side opening 22 in the vertical direction. The respective contact spring pieces 18, 19 are formed while the respective basal plate portions 15, 16 and the connecting plate portions 17 are in a planarly-developed state. After the respective contact spring pieces 18, 19 are formed, the respective basal plate portions 15, 16 and the respective connecting plate portions 17 are bent at a right angle with respect to each other. Also, the respective engagement pieces 20 are bent at a right angle. Then, a cut end 15*a* at a right-hand end of the upper basal plate portion 15 is fixed to a downward-extending fixation piece 24 (FIG. 5) while the cut end 15*a* is placed above a flange portion 17*a* at an upper end of the one connecting plate portion 17 (the one side wall).

As shown in FIG. 1, the respective pairs of engagement pieces 20 of the spring member 24 are engaged at the respective locking apertures 11 of the terminal main body 3. At each of the locking apertures 11, the front engagement piece 20 of the pair of engagement pieces 20 abuts on a front end face of the locking aperture 11, and a rear engagement piece 20 abuts on a rear end face of the locking aperture 11, thereby firmly fixing the spring member 4 to the terminal main body 3 without any positional displacement (loosening) in a front-rear direction.

The spring member 4 may be, for example, mounted at the terminal main body 3 while the terminal main body 3 being in a disassembly-developed state. Since the spring member 4 includes the front-and-rear, upper-and-lower and right-and-left openings 12, 13, 21 and 22, the spring member 4 can be flexibly deformed. For example, while the terminal main body 3 is in a state in which only the upper wall 5 is vertically developed and the both walls 7 are extending vertically from the lower wall 6 of the terminal main body 3, the spring member 4 which is flexibly deformed and compressed in the width (horizontal) direction is mounted inside the terminal main body 3 (compression in the width direction facilitates the insertion of the engagement piece 20 into the locking aperture 11). Followed by that, the upper wall 5 is bent to a horizontal position.

Figure 5:
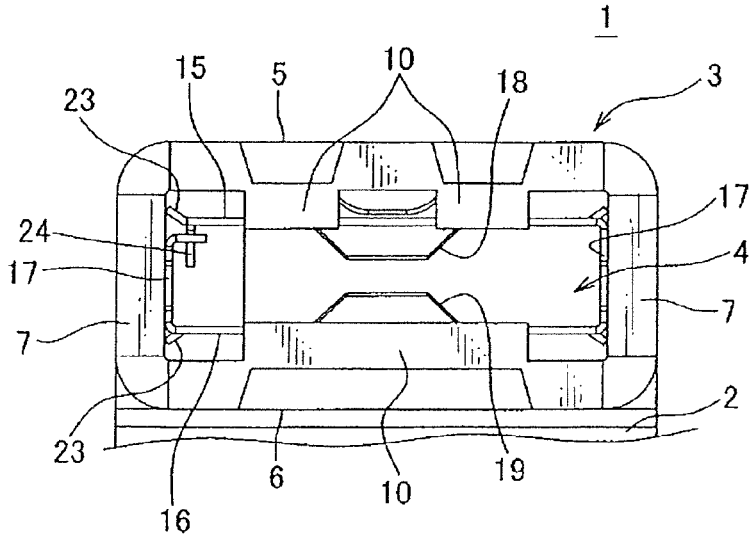
FIG. 5 is a front view of the terminal.

Alternatively, the terminal main body 3 may be formed into a box-like shape at first, as shown in FIG. 1, and then while the spring member 4 is flexibly deformed by pushing the upper and lower basal plate portions 15, 16 inwardly by fingers, the spring member 4 can be inserted into and mounted within the terminal main body 3. As shown in FIG. 5 (front view), the upper and lower projections 10 at least the front end of the terminal main body 3 are arranged at a central portion of the upper and lower basal plate portions 15, 16 of the spring member 4, not including right and left end portions of the upper and lower basal plate portions 15, 16. Consequently, the central portion of the upper and lower basal plate portions 15, 16 can be flexibly deformed, and thus the spring member 4 can be inserted between the upper and lower projections 10.

Each of the engagement pieces 20, due to a flexibility thereof, flexibly deforms along the side wall 7 of the terminal main body 3 and then engages with the engagement hole 11. In this way, the mounting workability is improved compared to the previously-described mounting which takes place while the terminal main body 3 is in the disassembly-developed state. The right-and-left engagement pieces 20 firmly fix, without a loose, the spring member 4 to the terminal main body 3. As shown in FIG. 5, there are provided two short upper projections 10 and a single elongated lower projection 10.

As shown in FIG. 2, the upper and lower contact spring pieces 18, 19 projecting upwardly and downwardly in a tilted manner, respectively, from each of the basal plate portions 15, 16. An inwardly-extending portion 18*a*, 19*a* of the respective contact spring pieces 18, 19 extends in a tilted manner towards a space inside the terminal main body 3 through which the mating terminal is inserted. The respective inwardly-extending portions 18*a*, 19*a* include a horizontal, short contact portion 18*b*, 19*b* arranged at a projecting tip portion of the inwardly-extending portion 18*a*, 19*a*. An outwardly-extending portion 18*c*, 19*c* of the respective contact spring pieces 18, 19 extends in a tilted manner towards the upper and lower walls 5, 6 of the terminal main body 3. The respective outwardly-extending portions 18*c*, 19*c* include a horizontal, short support portion 18*d*, 19*d* arranged at a projecting tip portion of the outwardly-extending portion 18*c*, 19*c*.

The support portion 18*d*, 19*d* at the tip portion of the outwardly-extending portion 18*c*, 19*c* of the respective upper and lower contact spring pieces 18, 19 elastically abuts on (contact with) an inner face of the upper and lower walls 5, 6 of the terminal main body 3, thereby locating the spring member 4 so as to align centripetally (align along a center) with respect to the height direction of the terminal main body 3. In this condition, the mating terminal 9 is inserted, and the contact portion 18*b*, 19*b* at the tip portion of the inwardly-extending portions 18*a*, 19*a* of the respective upper and lower contact spring pieces 8, 9 elastically contacts with each of an upper and a lower flat face of the mating terminal 9. Consequently, the spring member 4 electrically contacts with the terminal main body 3 via the right and left connecting plate portions 17 contacting with the right and left side walls 7, and the outwardly-extending portions 18*c*, 19*c* of the upper and lower contact spring pieces 18, 19 contacting with the upper and lower walls 5, 6, as shown in FIG. 5, as well as the engagement pieces 20 contacting with the locking apertures 20 (FIG. 1).

As shown in FIG. 2, the mating terminal 9 is smoothly inserted in a direction of the tilt of the respective contact spring pieces 18, 19 with a low friction. A distance (space) between the projecting tips 18*b*, 19*b* of the upper and lower contact spring pieces 18, 19 in a free state is smaller than the plate thickness of the mating terminal 9, so the upper and lower contact spring pieces 18, 19 elastically contact with the mating terminal 9 in a simultaneous manner and with an equivalent force.

When inserting the mating terminal 9, firstly, the upper-and-lower pair of contact spring pieces 18, 19 at the front contacts (slidably contacts) with the mating terminal 9, and then the upper-and-lower pair of contact spring pieces 18, 19 at the middle contacts (slidably contacts) with the mating terminal 9, and finally the upper-and-lower pair of contact spring pieces 18, 19 at the rear contacts (slidably contacts) with the mating terminal 9. In this way, the respective upper and lower contact spring pieces 18, 19 contact with the mating terminal 9 at a temporal interval. Consequently, an insertion force of the mating terminal 9 with respect to the spring member 4 increases gradually. As a result, the insertion of the mating terminal 2 can be performed smoothly with a small force.

This is the same in removing the mating terminal 9 from the spring member 4. When removing the mating terminal 9 from the spring member 4, firstly, the upper-and-lower pair of contact spring pieces 18, 19 at the rear separates from the mating terminal 9 (the upper-and-lower pair of contact spring pieces 18, 19 at the front and the middle are in contact with the mating terminal 9), and then the upper-and-lower pair of contact spring pieces 18, 19 at the middle separates from the mating terminal 9 (the upper-and-lower pair of contact spring pieces 18, 19 at the front are in contact with the mating terminal 9), and finally the upper-and-lower pair of contact spring pieces 18, 19 at the front separates from the mating terminal 9. In this way, the respective upper and lower contact spring pieces 18, 19 are separated from the mating terminal 9 at a temporal interval, thereby gradually decreasing a removal force of the mating terminal 9 with respect to the spring member 4. As a result, the removal of the mating terminal 9 can be performed smoothly with a small force.

As shown in FIG. 3, even if the plate thickness T of the mating terminal 9 is small, the upper and lower contact spring piece 18, 19 elastically restores its position inwardly and contact with the mating terminal 9. The mating terminal 9 is thus self-aligned in a centripetal manner (aligned along a center) by the upper and lower contact spring pieces 18, 19, and is located in parallel with the upper and lower basal plate portions 15, 16 at the height of the half the distance (space) between the upper and lower basal plate portions 15, 16. FIGS. 2 and 3 show the view in which the front side and the rear side are reversed.

Regarding to the designing dimension, when the distance between the upper and lower projections 10 of the terminal main body 3 is indicated by a reference sign A, the plate thickness of the mating terminal 9 by T, the minimum allowable displacement of the upper and lower contact spring pieces 18, 19 by 2B, and the maximum allowable displacement of the upper and lower contact spring pieces 18, 19 by 2C, the parameters satisfy a relationship described by $T+2B<A<T+2C$. Thus the projection height of the projection 10 is determined so as to satisfy this relationship.

The mating terminal 9 according to this example is connected to an electric wire (not shown). If an external force is applied to the electric wire and such and the mating terminal 9 is moved upwardly and downwardly in an undesirable manner, since the respective upper and lower contact spring pieces 18, 19 always remain in contact with the mating terminal 9, points of contact with respect to the mating terminal 9 do not decrease. Even if the mating terminal 9 is largely moved upwardly and downwardly, the upper and lower projections 10 abut on the mating terminal 9 and thereby regulate the position of the mating terminal 9, thereby preventing the further movement of the mating terminal 9. Consequently, the contact load of the each of the upper and lower contact spring pieces 18, 19 can be maintained above the designed value, and the adverse plastic deformation (a loss of resilience) or breakage of the contact spring pieces 18, 19 can be prevented.

As shown in FIG. 5, the upper and lower contact spring pieces 18, 19 are arranged to extend inwardly at a center along the width direction of the upper and lower basal plate portions 15, 16, arranged at opposing positions with respect to each other, and arranged in a substantially trapezoidal shape in front view. An outer face of the right-and-left connecting plate portions 17 of the spring member 4 contacts with an inner face of the right-and-left side walls 7 of the terminal main body 3. In FIG. 5, the reference sign 23 indicates the tilted protrusion at the right and the left ends, and the reference sign 2 indicates the bus bar.

Figure 6A:
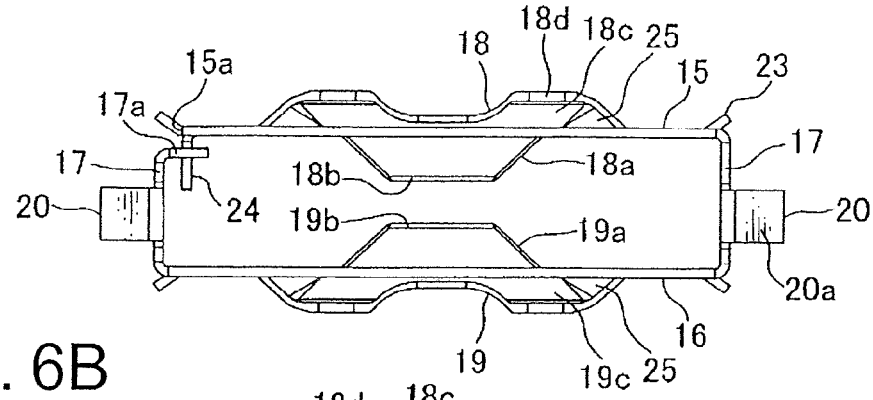
FIGS. 6A and 6B are a front view and a side view, respectively, showing the spring member in more detail.
Figure 6B:
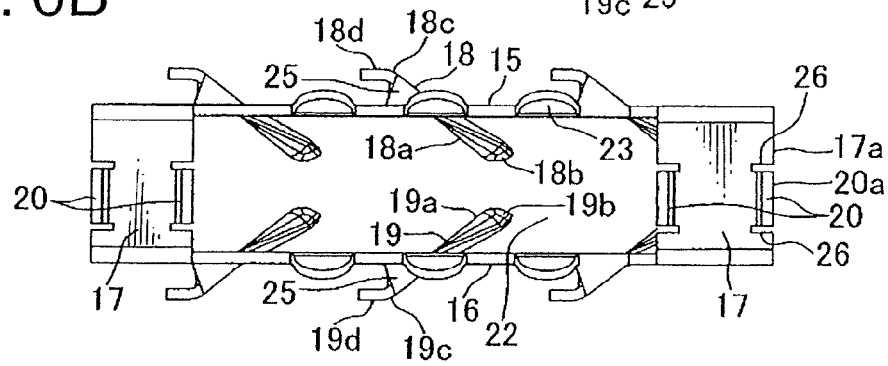

FIGS. 6A and 6B show a front view and a side view of the spring member 4, respectively. The inwardly-extending portions 18*a*, 19*a* of the respective upper and lower contact spring pieces 18, 19 are arranged to extend longer than the outwardly-extending portions 18*c*, 19*c*, and are formed so as to be gradually narrowed towards the projecting tips 18*b*, 19*b* in a tapered manner. The outwardly-extending portion 18*c*, 19*c* attaches to the basal plate portions 15, 16, respectively, via a tapered (fan-like) hinge wall 25. For example, when the mating terminal 9 is inserted, the contact spring piece 18, 19 elastically rotates in the vertical direction via the hinge wall 25 which serves as a pivot point.

The substantially semi-circular shaped upper and lower tilted protrusions 23 of the side opening 22 provided between the front and rear connecting plate portions 17 project lower relative to the outwardly-extending portions 18*c*, 19*c* of the contact spring pieces 18, 19. When the contact spring pieces 18, 19 are rotated at its maximum, all of the upper and lower tilted protrusions 23 and the outwardly-extending portions 18*c*, 19*c* can simultaneously contact with, or only the upper and lower tilted protrusions 23 can contact with, the upper and the lower walls 5, 6 of the terminal main body 3. The reference sign 24 corresponds to a portion at which the cut end 15*a* of the upper basal plate portion 5 is fixed to the flange portion 17*a* of the upper end of the connecting plate portion 17.

The engagement piece 20 according to this exemplary embodiment is arranged at the respective connecting portions 17 at a position slightly lower relative to the center with respect to the height direction of the connecting plate portion 17. There are provide horizontal upper and lower slits 26 at the connecting plate portion 17, the depth of the slit 26 being greater relative to the plate thickness of the engagement piece 20, to provide the engagement piece 20 the elasticity in the plate thickness direction. An outer face 20*a* of the engagement piece 20 and the front and rear ends 17*a* of the connecting plate portion 17 are arranged in the same vertical plane. The engagement piece 20 has a rectangular-shape, and the projecting length thereof is substantially equivalent to the projecting length of the inwardly-extending projection 18*a*, 19*a* of the contact spring piece 18, 19. A front end of the front connecting plate portion 17 is positioned at a front end of the upper and lower basal plate portions 15, 16, and a rear end of the front connecting plate portion 17 is positioned at a rear end of the upper and lower basal plate portions 15, 16.

Figure 7:
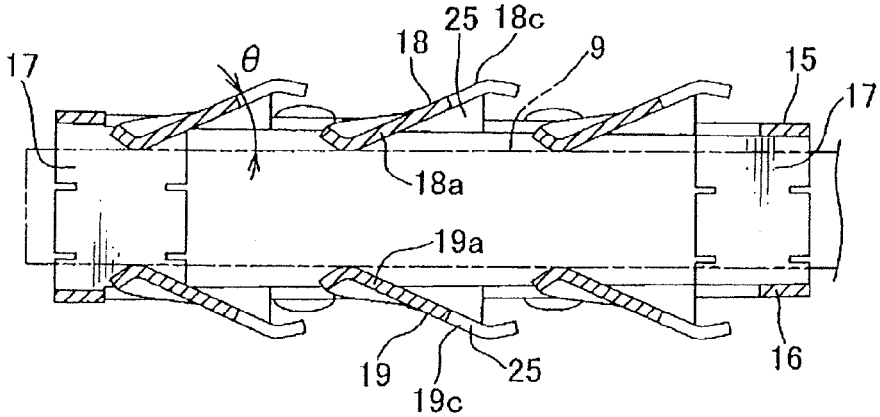
FIG. 7 is a vertical cross section showing a state in which the mating terminal is inserted into the spring member.

As shown in FIG. 7, for example, when inserting the mating terminal 9, the respective upper and lower contact spring pieces 18, 19 rotatably move in the plate thickness direction of the mating terminal around the hinge wall 25 as the pivot point (the inwardly-extending projection 18*a*, 19*a* rotates outwardly, and the outwardly-extending projection 18*c*, 19*c* rotates inwardly), thus a tilt angle θ of each of the contact spring pieces 18, 19 becomes smaller relative to that of in the free state shown in FIGS. 6A and 6B.

The respective front and rear pairs of connecting plate portions 17 as a connecting portion horizontally connecting the upper and lower basal plates 15, 16, i.e. the respective upper and lower contact spring pieces 18, 19, are connected vertically. Thus, when inserting the mating terminal 9, the basal plate portions 15, 16 are prevented from being deformed, thereby preventing an escape of load which may be caused by the deformation. As a result, the variation in contact load for the respective contact spring pieces with respect to the mating terminal 9 can be prevented, improving the electrical connection reliability.

Furthermore, the engagement piece 20 is provided at the connecting plate portion 17 so as to engage with the locking aperture 11 of the terminal main body 3, and the non-deforming outer face 20*a* of the engagement piece 20 serves to securely maintain the position with respect to the terminal main body 3. Consequently, when inserting and removing the mating terminal 9, the position of the spring member 4 can be stably and firmly maintained with respect to the terminal main body 3.

Figure 8:
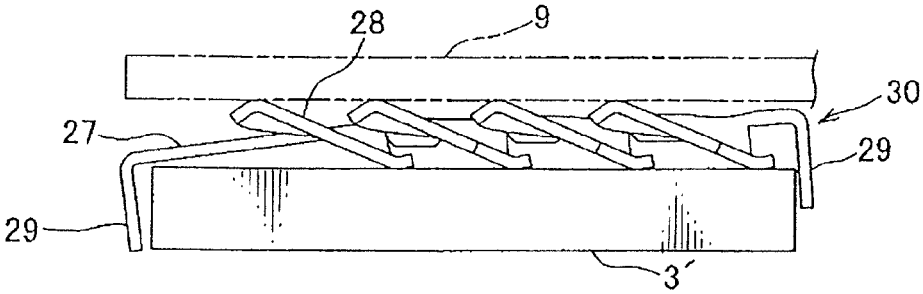
FIG. 8 is an explanatory side view showing a problem of a spring member which is different from the spring member of the present invention.

For example, as shown in reference with an exemplary drawing of FIG. 8, there are provided an engagement portion 29 for a terminal main body 3' and a plurality of contact spring pieces 28 formed at a single basal plate portion 27 with a front end and a rear end of the basal plate portion 27 being folded. In this case, when the mating terminal 9 is inserted, the basal plate portion 27 deforms in a slanted manner, causing an escape of a load to the basal plate portion 27, further causing the significant variation in a contact load for the respective contact spring pieces. In addition, the engagement portion 29 as a position-maintaining portion with respect to the terminal main body 3 becomes a point contact portion, thereby decreasing the position-maintaining reliability for the spring member 30 when inserting and removing the mating terminal 9. These problems are solved by the spring member 4 according to FIGS. 6 and 7.

Furthermore, in the above-described first embodiment, although the terminal main body 3 is provided with the locking aperture (locking portion) 1, and the spring member 4 is provided with the engagement piece (engagement portion) 20, however, the terminal main body 3 may be provided with an engagement piece (engagement portion) and the spring member 4 may be provided with a locking aperture (locking portion). In this case, however, there may be a problem that, the inwardly-projecting engagement piece interfering with the mating terminal 9, and also that, it is difficult to check the engagement condition between the locking aperture and the engagement piece by looking from outside.

Furthermore, in the above-described first embodiment, although the terminal 1 is formed at the bus bar 2 and the mating terminal 9 is connected (clamped) to the electric wire, however, for example, both of the male and terminals 1, 9 may be connected to the electric wire or integrally formed at the bus bar 2.

Furthermore, in the above-described first embodiment, although the terminal main body 3 and the spring member 4 are formed separately, however, the terminal main body 3 and the spring member 4 may be formed in one. In this case, the upper and lower basal plate portions 15, 16 and the right and left connecting portions 17 can be eliminated by being integrally formed with the upper and lower walls 5, 6 and the right and left side walls 7 of the terminal main body 3, respectively, so that only the upper and lower contact spring pieces 18, 19 project inwardly from the upper and lower walls 5, 6 of the terminal main body 3.

FIGS. 9 through 12 show a terminal of the present invention according to a second embodiment.

Figure 9:
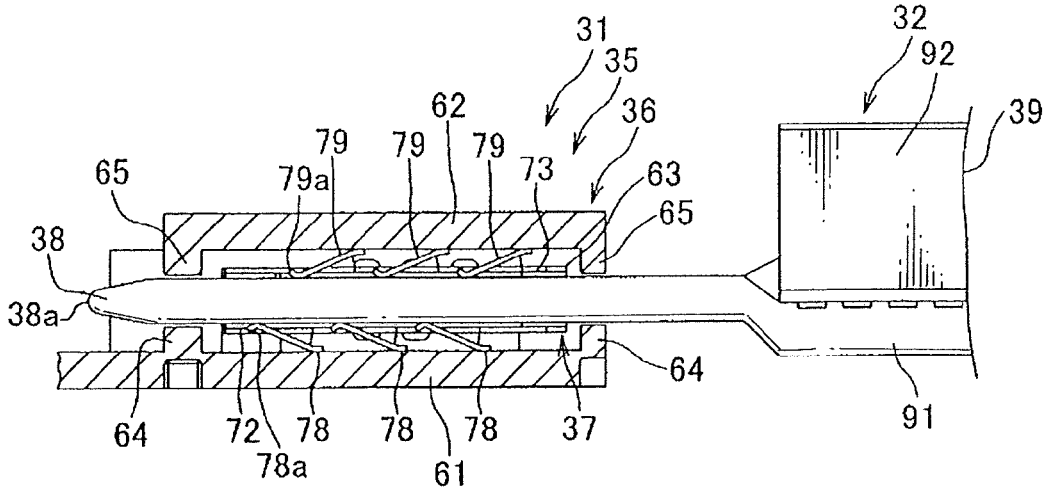
FIG. 9 is a vertical cross section of a terminal of the present invention according to a second embodiment in a state in which a mating terminal is inserted into the terminal.
Figure 10:
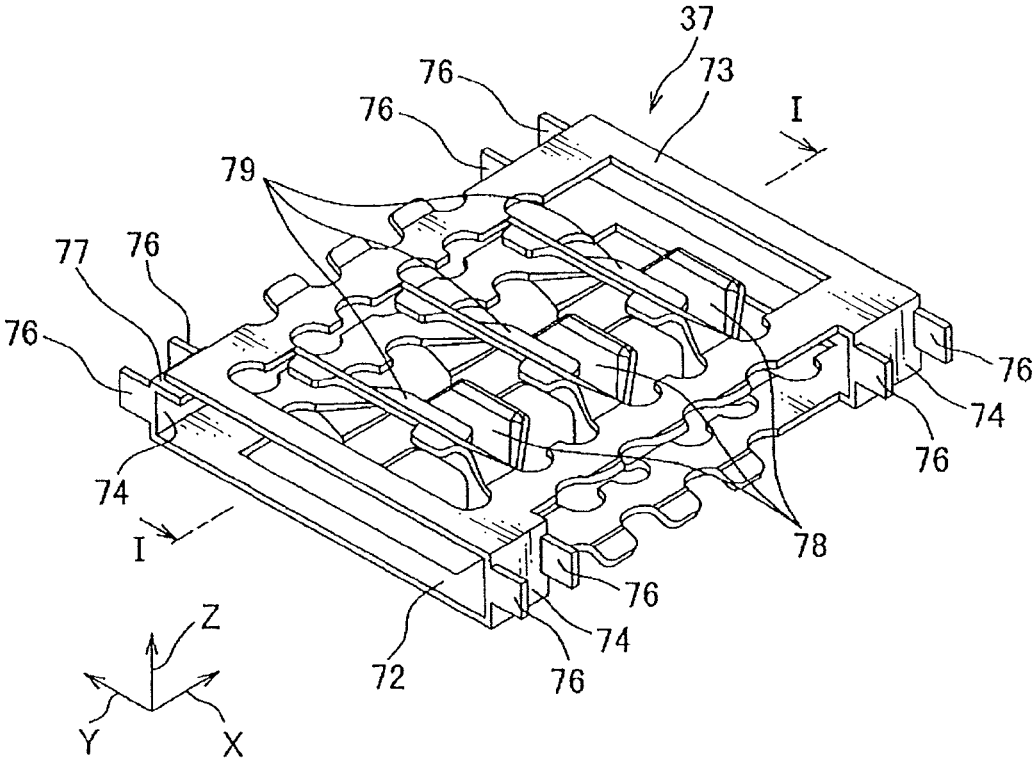
FIG. 10 is a perspective view showing the terminal according to one embodiment.

As shown in FIG. 9, a mating terminal (terminal clamp) 32 is inserted into a terminal (terminal clamp) 31, electrically connecting an electric wire not shown with a male-type tab such as a bus bar or an electric component such as a relay and a fuse. In FIG. 10, an arrow X indicates a direction of insertion of the mating terminal 32 into the terminal 31 as well as the longitudinal direction of the terminal 31, an arrow Y indicates the width direction of the terminal 31, and an arrow Z indicates the height direction of the terminal 31.

The mating terminal 32 is formed for example by bending a conductive flat metal plate and includes a plate-like electrical contact portion (insertion portion) 38 which is inserted into a later-described electrical contact portion 35 of the terminal 31 and an electric wire connection portion 39 connected to the electric wire. The electrical contact portion 38 includes a tapered tip portion 38*a*. The electric wire connection portion 39 includes a flat, rectangular bottom plate 91 continuous with the electrical contact portion 38, a pair of clamp pieces 92 connected to the bottom plate 91 along the width direction thereof. An exposed core wire at an end portion of the electric wire is placed on a surface of the bottom plate 91 and is clamped and connected by the clamp piece 92.

The terminal 31 includes the electrical contact portion 35 electrically connected with the mating terminal 32 and an electrical connection portion not shown. The electrical connection portion is connected to a male-type tab terminal of a bus bar and such or a connection terminal of an electric component such as a relay and a fuse. The electric contact portion 35 includes a rectangular tube-shaped terminal main body 36 into which the electric contact portion 38 of the mating terminal 32 is inserted, and a spring member 7 mounted inside the terminal main body 36.

The terminal main body 36 includes a lower wall (bottom wall) 61, an upper wall (ceiling wall) 62 opposing to the lower wall 61 with a space from the lower wall 61, and a pair of right and left side walls 63 connecting the lower wall 61 with the upper wall 62. The lower wall 61 corresponds to "one wall" and the upper wall 62 corresponds to "the other wall". The lower wall 61 has a rectangular planar shape and includes two first projections 64 on a surface facing the upper wall 62.

The first projection 64 is arranged to project from both longitudinal ends (in X direction) of the lower wall 61 towards the upper wall 62. These first projections 64 are formed by pressing the lower wall 61 with a press. The upper wall 62 has the rectangular planar shape equivalent to the lower wall 61. The upper wall 62 includes two second projections 65 on a surface facing the lower wall 61.

The second projection 65 is arranged at a position opposed to the first projection 64. That is, the second projection 65 projects from both longitudinal ends (in X direction) of the upper wall 62 towards the lower wall 61. These second projections 65 are fainted by pressing the upper wall 62 by a press. With the electric contact portion 38 inserted (sandwiched) between the first projection 64 and the second projection 65, if an external force in a direction orthogonal to the insertion direction of the electrical contact portion 38 (X direction), the first projection 64 and the second projection 65 abut on the electrical contact portion 8.

The side wall 63 includes two rectangular locking apertures (receiving portions not shown) into which an engagement piece 76 (FIG. 10) projecting from the spring member 7 is inserted and locked. The locking aperture is formed to penetrate through the side wall 63 and is located with a space from a longitudinal (X direction) end of the side wall 63, thereby locking the engagement piece 76 of the spring member 37 when the spring member 37 is mounted inside the terminal main body 36.

As shown in FIG. 10, the spring member 37 is constituted of a conductive flat metal plate and includes a pair of upper and lower basal plate portions 72, 73 opposing to each other, a connecting plate portion 74 connecting the pair of basal plate portions 72, 73 together, a first contact spring piece (elastic piece) 78, a second contact spring piece (elastic piece) 79 and the projecting piece 76 which is inserted into and engaged with the locking aperture.

When the spring member 37 is mounted inside the terminal main body 36, the pair of basal plate portions 72, 73 is positioned at an inner side of the walls 61, 62 of the terminal main body 36, so that the electric contact portion 38 of the mating terminal 32 enters between the walls 61, 62. The upper basal plate portion 72 adjacent to the upper wall 62 includes an engagement piece 70 (FIG. 15) which engages with an overlap portion 77 of the connecting plate portion 74 when assembling the spring member 37.

There are provided two rectangular connecting plate portions 74 at both ends of the basal plate portion 72, 73 in the longitudinal direction (X direction) as well as at both ends of the basal plate portion 72, 73 in the width direction (Y direction), respectively. Therefore, there are provided total of four connecting plate portions. The two connecting plate portions 74 provided at both ends of the basal plate portion 72, 73 in the longitudinal direction (X direction) are arranged with a space between each other, and there is provided an opening between these connecting plate portions 74. The spring member 37 can be flexibly deformed in the height direction (Z direction). Of these four connecting plate portions 74, two connecting plate portions 74 at one end of the basal plate portion 72, 73 in the width direction (Y direction) are provided with the overlapping portion 77 having an engagement aperture (receiving portion not shown), the engagement aperture being arranged to engage with the engagement piece 70 (FIG. 15) when assembling the spring member 7.

The first (the one) contact spring piece 78 is provided only at the one (lower) basal plate portion 72 of the pair of basal plate portions 72, 73. The second (the other) contact spring piece 79 is provided only at the other (upper) basal plate portion 73 of the pair of basal plate portions 72, 73. The plurality of respective contact spring pieces 78, 79 are aligned at an interval and parallely with respect to each other along the insertion direction of the electrical contact portion 38 of the mating terminal 32. The contact spring pieces 78, 79 are formed by partially cutting the respective basal plate portions 72, 73 and bending upwardly (downwardly). The contact spring piece 78, 79 elastically rotates along the height direction of the spring member 7 around a connection portion as a pivot point, at which the contact spring piece 78, 79 contacting with the basal plate portion 72, 73. The contact spring piece 78, 79 is arranged in a substantially trapezoidal shape in front view, and has a shape gradually narrowed towards the projecting tip portions 78*a*, 79*a* pointing inside the spring member 7.

A base end portion of the first contact spring piece 78 distant from the tip portion 78*a* is arranged towards the mating terminal 32, and arranged adjacent to the lower wall 61 of the terminal main body 36 so as to contact with the lower wall 61. The tip portion 78*a* of the first contact spring piece 78 is formed so as to tilt with respect to the lower wall 61 such that the tip portion 78*a* gets closer to the upper wall 62 with distance from the above-described base end portion toward a rear direction of the insertion direction (X direction). In this manner, the first contact spring piece 78 extends from the lower wall 61 towards the upper wall 62. When the electrical contact portion 38 of the mating terminal 32 is inserted into the terminal main body 36, the electrical contact portion 38 pushes the first contact spring piece 78 towards the one (lower) basal plate portion 72. The first contact spring piece 78, due to the elastic restoring force thereof, thus pushes the electrical contact portion 38 in a direction from the one basal plate portion 72 towards the other basal plate portion 73 adjacent to the upper wall 62 (i.e., towards the second contact spring piece 79), thereby sandwiching the electrical contact portion 38 between the first contact spring piece 78 and the second spring piece 79.

A base end portion of the second contact spring piece 79 distant from the tip portion 79*a* is arranged towards the mating terminal 32 and arranged so as to contact with the upper wall 62. The tip portion 79*a* of the second contact spring piece 79 is formed so as to tilt with respect to the upper wall 62 such that the tip portion 79*a* gets closer to the lower wall 61 in a rear direction with respect to the insertion direction (X direction) with distance from the above-described base end portion. In this manner, the second contact spring piece 79 extends from the upper wall 62 towards the lower wall 61. When the electrical contact portion 38 is inserted into the terminal main body 36, the electrical contact portion 38 pushes the second contact spring piece 79 towards the other basal plate portion 73. Then, the second contact spring piece 79, due to the elastic restoring force thereof, pushes the electrical contact portion 38 in a direction from the other basal plate portion 73 towards the one basal plate portion 72 adjacent to the lower wall 61 (i.e., towards the first contact spring piece 78). Consequently, the electrical contact portion 38 is sandwiched between the first contact spring piece 78 and the second spring piece 79.

Figure 11:
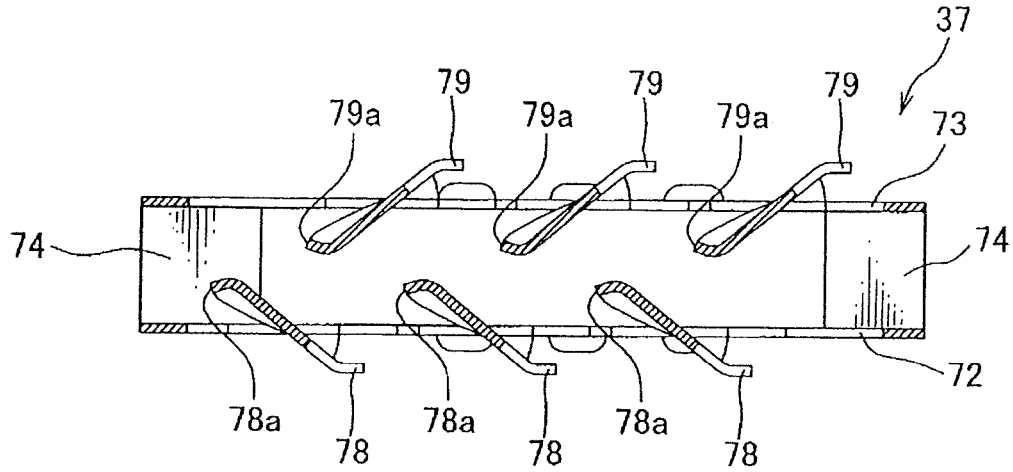
FIG. 11 is a cross sectional view taken along a line I-I shown in FIG. 10.
Figure 12:
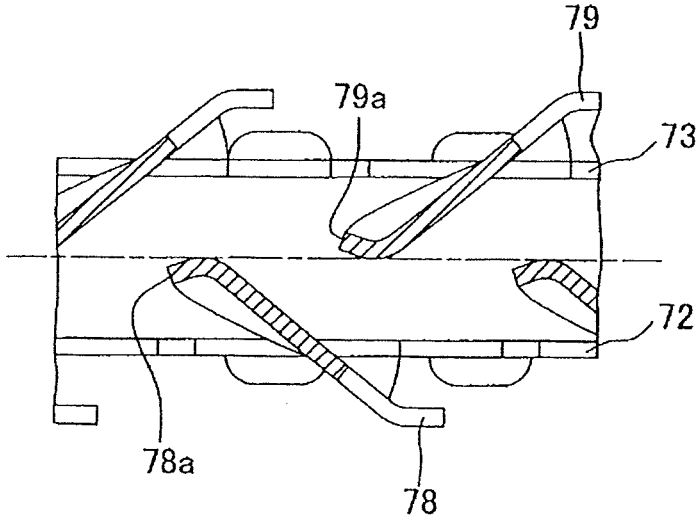
FIG. 12 is an enlargement view of a portion of the spring member of FIG. 11.

As shown in FIG. 11 and FIG. 12, the tip portion 78*a* of the lower first contact spring piece 78 and the tip portion 79*a* of the upper second contact spring piece 79 are arranged in a staggered alignment so as to be aligned alternately (one after the other) along the insertion direction of the electrical contact portion 38 of the mating terminal 32 (X direction). This staggered alignment of the respective upper and lower contact spring pieces 78, 79 along the insertion direction of the mating terminal 2, is a characteristic feature of the spring member 37 according to the second embodiment.

The size and the shape of the upper and lower contact spring pieces 78, 79 are equivalent with respect to each other, as well as the spring force (elastic restoring force) thereof. The number of the first contact spring pieces 78 and the first contact spring pieces 79 according to this embodiment are three, respectively. However, this number may be two or four, or even one, according to the amount of the flowing current value (that is, the larger the flowing current value, the greater the number of the first contact spring piece 78 and the second contact spring piece 79).

As shown in FIG. 10, there is provided the single pair of engagement pieces 76 per connecting plate portion 74, the engagement piece 76 being arranged to project outwardly from an edge of both ends of the connecting plate portion 74 in the longitudinal direction (X direction). Of the pair of projecting pieces 76, one projecting piece 76 abuts on an end face of the locking aperture (not shown) of the terminal main body 36 located in a front side on the X direction, and the other projecting piece 76 abuts on an end face of the locking aperture (not shown) of the terminal main body 36 located in a rear side on the X direction, thereby firmly fixing the spring member 37 at the terminal main body 36 without any positional displacement (loosening).

The following describes an assembling procedure of the above-described terminal 31. Firstly, while the basal plate portions 72, 73, the connecting plate portions 74, and the engagement pieces 76 are in a disassembly-developed state, the contact spring piece 78, 79 is aimed by cutting and bending upwardly (downwardly) the basal plate portion 72, 73. Then, the connecting plate portion 74 and the overlapping portion 77 are bent at a right angle, and the basal plate portion 72, 73 and the connecting plate portion 74 are bent at a right angle. The other end of the basal plate portion 73 is then overlappingly placed above the overlapping portion 77 to engage the engagement piece 70 with the engagement aperture, and then the respective engagement pieces 76 are bent outwardly so as to project. In this manner, the spring member 37 is assembled.

Furthermore, while the lower wall 61, the upper wall 62 and the side wall 63 of the terminal main body 36 are in a disassembly-developed state, the lower wall 61 and the side wall 63 are bent at a right angle, and then the side wall 63 and the upper wall 62 are bent at a right angle, followed by joining the side wall 63 with the upper wall 62. In this manner, the terminal main body 36 is assembled.

Then, the spring member 37 in which the basal plate portions 72, 73 are flexibly deformed is inserted into the rectangular tube-shaped terminal main body 36. Then, the engagement piece 76 is flexibly deformed and engaged with the locking aperture to lock (assemble) the spring member 37 and the terminal main body 36 with respect to each other. In this state, the base end portion of the contact spring piece 78, 79 elastically abuts on (contact with) an inner face of the wall 61, 62, thereby locating the spring member 37 so as to align centripetally (align along a center) with respect to the height direction (Z direction) of the terminal main body 36. Thus, since the engagement piece 76 abuts on the end face of the respective locking apertures, and the base end portion of the contact spring piece 78, 79 abuts on the inner face of the wall 61, 62, so the spring member 37 is electrically connected to the terminal main body 36. In this manner, the electrical contact portion 35 is assembled, and terminal 31 is completed.

Next, a procedure of mounting the mating terminal 32 to the above-described terminal 31 is explained below. When the tip portion 38*a* of the electric contact portion 38 of the mating terminal 32 enters into the electrical contact portion 35, the tip portion 38*a* of the electrical contact portion 38 contacts with the tip portion 79*a* of the second spring piece 79 located in front with respect to the insertion direction (X direction). When the electrical contact portion 38 is moved further in the insertion direction, the tip portion 38*a* of the electrical contact portion 38 contacts with the tip portion 78*a* of the first contact spring piece 78 located in front with respect to the insertion direction. Thus, by moving the electrical contact portion 38 towards the rear side in the insertion direction (X direction), the first contact spring piece 78 and the second contact spring piece 79 alternatively contact with the electrical contact portion 38. During this step, the tip portion 38*a* of the electrical contact portion 38 rotates (pushes) the tip portion 79*a* of the second contact spring piece 79 outwardly and further moves towards the rear side in the insertion direction (X direction), while the tip portion 38*a* of the electrical contact portion 38 also rotates (pushes) the tip portion 78*a* of the first contact spring piece 78 outwardly and further moves towards the rear side in the insertion direction (X direction). In this manner, the terminal 31 is connected with the mating terminal 32.

According to the second embodiment described above, the tip portion 78*a* of the lower first contact spring piece 78 and the tip portion 79*a* of the upper second contact spring piece 79 are arranged in a staggered alignment so as to be aligned alternately (one after the other) along the insertion direction (X direction) of the electrical contact portion 38 of the mating terminal 32. Thus, since the tip portion 78*a* of the lower first contact spring piece 78 and the tip portion 79*a* of the upper second contact spring piece 79 are arranged alternatively in a staggered manner along the height direction (Z direction) of the spring member 37 so as not to overlap with respect to each other, thus the height of the electrical contact portion 35 (dimension in Z direction) is reduced, thereby downsizing the terminal 31 (i.e. the electrical contact portion 35).

Furthermore, since the plurality of connecting plate portions 74 which connects the pair of the basal plate portions 72, 73 of the spring member 37 to each other, is arranged with a space between each other at both ends along the insertion direction (X direction) of the electrical contact portion 38 of the mating terminal, and since the space between the connecting plate portions 74 is opened, thus the pair of basal plate portions 72, 73 can be flexibly deformed, so that the spring member 37 can be easily mounted in the terminal main body 36.

Furthermore, since there is provided the engagement piece 76 arranged to project outwardly from the connecting plate portion 74, and the locking aperture which is provided at the terminal main body 6 and which engages with the engagement piece 76, the spring member 37 can be easily mounted (fixed) at the terminal main body 36 by simply engaging the engagement piece 76 with the locking aperture. In addition, since the engagement piece 76 abuts on the end face of the locking aperture to mount the spring member 37 in the terminal main body 36, even if the mating terminal 32 is inserted into and removed out from the electrical contact portion 35 forcefully, the spring member 37 is prevented from being easily detached from the terminal main body, thereby reducing defect rate of the terminal 31.

Furthermore, since the engagement pieces 76 are provided in a pair at both ends of the connecting plate portion 74 in the insertion direction (X direction), the pair of engagement pieces 76 of the respective connecting plate portion 74 abuts on the end face of the locking aperture at both of front and the rear side in the insertion direction (X direction) of the electrical contact portion 38. Consequently, the spring member 37 is firmly fixed to the terminal main body 36. As a result, even if the mating terminal 32 is inserted and removed forcefully, the spring member 37 is prevented further from being detached from the terminal main body 36.

Furthermore, since the plurality of contact spring pieces 78, 79 are arranged in parallel at an interval with respect to each other along the insertion direction (X direction), when inserting and removing the mating terminal 32, the number of contact spring pieces 78, 79 contacting with the electrical contact portion 38 of the mating terminal 32 increases or decreases gradually one by one. Consequently, insertion and removal of the mating terminal 32 can be performed with a small force.

Furthermore, since the tip portion 78*a*, 79*a* of the contact spring piece 78, 79 extends further inwardly than the tip portion of the projection 64, 65 which projects from the inner face of the terminal main body 36 facing the basal plate portion 72, 73. Consequently, even if an external force is applied in the direction orthogonal to the insertion direction (X direction) of the electrical contact portion 38 of the mating terminal 32, the electrical contact portion 38 which abuts on the projection 64, 65 is inhibited from moving further, and thus the contact between the contact spring piece 78, 89 and the electrical contact portion 38 of the mating terminal 32 can be reliably maintained, thereby improving the electrical connection reliability between the terminal 31 and the mating terminal 32.

Figure 13:
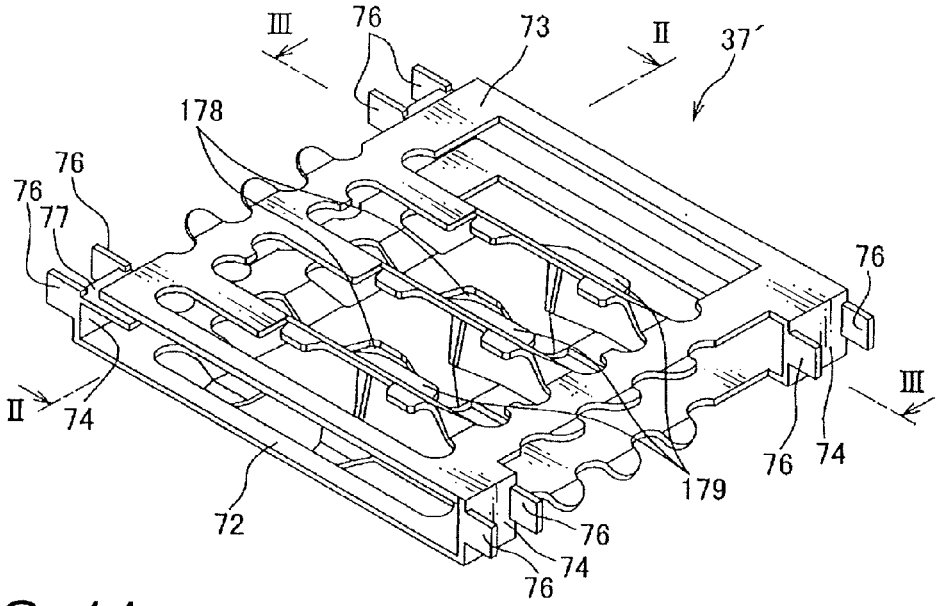
FIG. 13 is a perspective view showing one modification embodiment of the spring member of the terminal according to the second embodiment.
Figure 14:
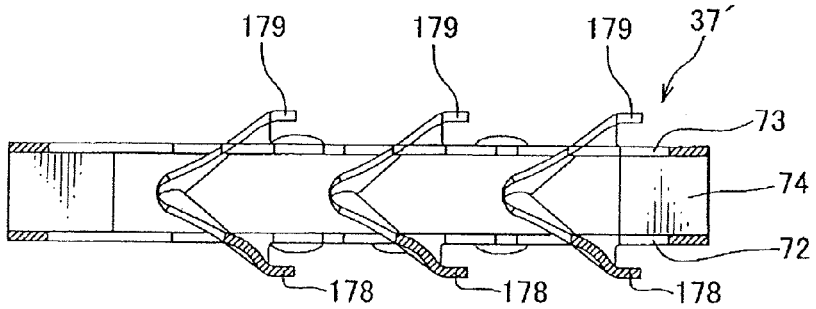
FIG. 14 is a cross sectional view taken along a line II-II shown in FIG. 13.
Figure 15:
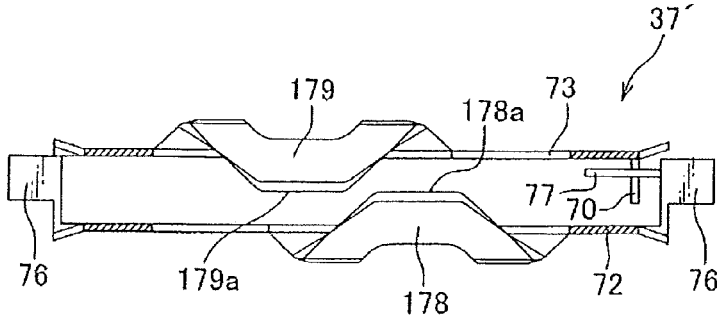
FIG. 15 is a cross sectional view taken along a line III-III shown in FIG. 13.
Figure 16:
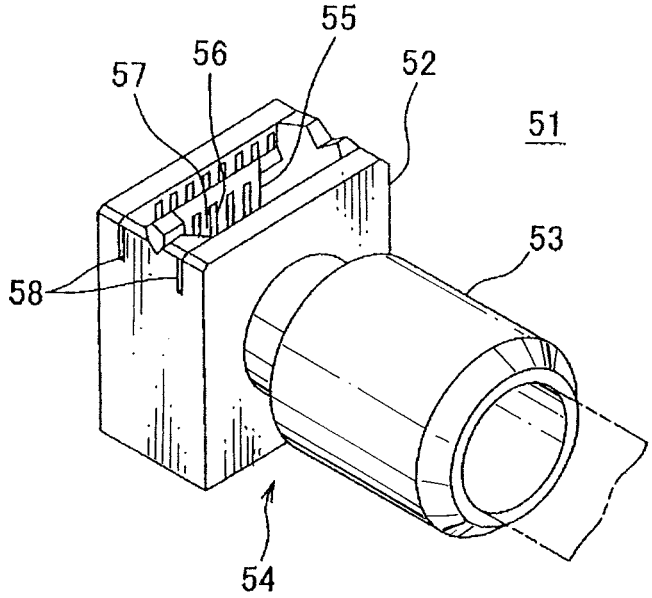
FIG. 16 PRIOR ART
FIG. 16 is a perspective view of a conventional terminal according to one embodiment.
Figure 17:
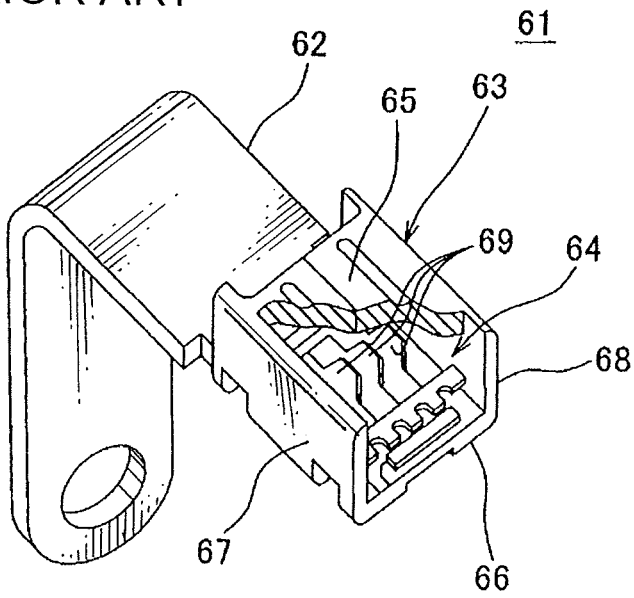
FIG. 17 PRIOR ART
FIG. 17 is a perspective view of the conventional terminal according to another embodiment in which a portion thereof being removed.

FIGS. 13 through 15 show one modification example of the spring member 37 used in the terminal 31 according to the above-described second embodiment. A terminal employing a spring member 37' according to one modification example is explained using the same reference signs used for the terminal 31 according to the second embodiment.

This terminal includes the electrical contact portion 35 to be electrically connected with the mating terminal 32. The electrical contact portion 35 includes the rectangular tube-shaped terminal main body 36 into which the electrical contact portion 38 of the mating terminal 32 is inserted, and the spring member 37' to be mounted inside the terminal main body 36. The terminal main body 36 includes the lower wall 61, the upper wall 62 facing to and arranged with a space from the lower wall 61, and the pair of side walls 63 connecting the lower wall 61 to the upper wall 62. The spring member 37' includes the pair of upper and lower basal plate portions 72, 73 facing each other, the connecting plate portion 74 connecting the pair of basal plate portions 72, 73, a lower, first contact spring piece (elastic piece) 178, an upper, second contact spring piece (elastic piece) 179 and the engagement piece 76 to be engaged with the locking aperture.

As shown in FIG. 15, for the spring member 37' according to this exemplary embodiment, each of the lower, first contact spring pieces 178 is arranged at the lower basal plate portion 72 to the right, and each of the upper, second contact spring pieces 179 is arranged at the upper basal plate portion 73 to the left, in which the respective upper and lower contact spring pieces 178, 179 are not alternatively-aligned but aligned at the same position in the front-and-rear direction with respect to each other, and are arranged parallel along the width direction (right-and-left direction) of the spring member.

The tip portion 178*a* of the first contact spring piece 178 pointing inside the spring member 37 and the tip portion 179*a* of the second contact spring piece 179 pointing inside of the spring member 37 are aligned alternatively along the direction (Y direction) orthogonal to both of the insertion direction (X direction) of the electrical contact portion 38 of the mating terminal 32 and the direction (Z direction) along which the lower wall 61 and the upper wall 62 face each other. That is, the tip portion 178*a* of the first contact spring piece 178 and the tip portion 179*a* of the second contact spring piece 179 are arranged alternatively (one after another) in a staggered-alignment along the width direction (Y direction) of the spring member 37'.

The following explains the procedure of connecting the mating terminal 32 to the terminal having the above-described spring member 37'. When the tip portion 38*a* of the electric contact portion (insertion portion) 38 of the mating terminal 32 enters into the electrical contact portion 35 of the female terminal, the tip portion 38*a* of the electrical contact portion 38 contacts with the tip portion 178*a* of the first spring piece 178 located in front side with respect to the insertion direction (X direction) as well as with the tip portion 179*a* of the second spring piece 179. Thus, in such manner, when the electrical contact portion 38 is moved further in the insertion direction, the first tip portion 178*a* and the second tip portion 179*a* contact simultaneously with the insertion portion 38, electrically connecting the mating terminal 32 with the terminal. During this step, the tip portion 38*a* of the electrical contact portion 38 rotates (pushes) the tip portion 179*a* of the second contact spring piece 179 outwardly while rotating (pushing) the tip portion 178*a* of the first contact spring piece 178 outwardly, and further moves towards the rear side in the insertion direction (X direction). In this manner, the terminal is connected with the mating terminal 32.

According to the above-described example of modified embodiment, the tip portion 178*a* of the first contact spring piece 178 pointing inside the spring member 37 and the tip portion 179*a* of the second contact spring piece 179 pointing inside the spring member 37 are aligned alternatively (one after another) along the direction (Y direction) orthogonal to both of the insertion direction (X direction) of the electrical contact portion 38 and the direction (Z direction) along which the lower wall 61 and the upper wall 62 face each other, and thus the tip portion 178*a* of the first contact spring piece 178 and the tip portion 179*a* of the second contact spring piece 179 are arranged in a staggered manner so as not to be overlapped with each other in the height direction (Z direction) of the spring member 7. Consequently, the height of the electrical contact portion 35 (dimension in Z direction) is reduced, thereby downsizing the terminal 31 (i.e. the electrical contact portion 35).

In the above-described second embodiment, although the first contact spring piece 78, 178 and the lower wall 61 are provided separately, however, the present invention is not limited to this, and the first contact spring piece 78, 178 and the lower wall 61 may be formed in one. The same can be applied in the first embodiment. Both of the cases including the case of separately providing the first contact spring piece 78, 178 and the lower wall 61 and the case of providing the first contact spring piece 78, 178 and the lower wall 61 are formed in one, are collectively referred to as "the first contact spring piece 78, 178 is extending from the lower wall 61 (the one wall) towards the upper wall 62 (the other wall)".

Furthermore, in the above-described second embodiment, although the second contact spring piece 79, 179 and the upper wall 62 are formed separately, however, the present invention is not limited to this, and the second contact spring piece 79, 179 and the upper wall 62 may be formed in one. In this description, both of the cases including the case of separately providing the first contact spring piece 79, 179 and the upper wall 62 and the case of providing the first contact spring piece 79, 179 and the upper wall 62 are fowled in one, are collectively referred to as "the second contact spring piece 79, 179 is extending from the upper wall 62 (the other wall) towards the lower wall 61 (the one wall)".

The embodiments described above are just representative embodiments of the present invention, and are not intended to limit the present invention. The present invention may be changed and modified without departing from the scope of the present invention.

INDUSTRIAL APPLICABILITY

The terminal according to the present invention may be applied to reliably connect high-voltage circuits of an electric motor vehicle such as an hybrid car, the connection can be performed with reduced electrical load.

REFERENCE SIGNS LIST

1, 31 terminal
3, 36 terminal main body
4, 37, 37' spring member
9, 32 mating terminal
10, 64, 65 projection
11 locking aperture (locking portion)
15, 16, 72, 73 basal plate portion
17, 74 connecting plate portion
18, 19, 78, 79, 178, 179 contact spring piece
20, 76 engagement piece (engagement portion)

The invention claimed is:

1. A terminal comprising:
a conductive, rectangular tube-shaped terminal main body;
a box-like spring member which is received in the terminal main body and into which a mating terminal is inserted;
a plurality of one contact spring pieces made of conductive material formed at an upper basal plate portion of the spring member in a plurality of rows in a mating terminal insertion direction, the plurality of one contact spring pieces projecting in a direction from an upper wall of the terminal main body to a lower wall of the terminal main body so as to tilt with respect to a mating terminal insertion direction; and
a plurality of the other contact spring pieces made of conductive material formed at a lower basal plate portion of the spring member, the plurality of the other contact spring pieces projecting in a direction from the lower wall to the upper wall so as to tilt with respect to the mating terminal insertion direction.

2. The terminal according to claim 1, wherein the plurality of one contact spring pieces and the plurality of the other contact spring pieces are arranged to align along the mating terminal insertion direction.

3. The terminal according to claim 2, wherein the one contact spring pieces and the other contact spring pieces are arranged at opposing positions along a thickness direction of the upper wall and the lower wall.

4. The terminal according to claim 2, wherein the one contact spring piece and the other contact spring piece are arranged alternatively in a staggered alignment along the mating terminal insertion direction.

5. The terminal according to claim 2, wherein the one contact spring piece and the other contact spring piece are arranged at the same position in the mating terminal insertion direction while arranged alternatively in a staggered alignment in a width direction of the wall.

6. The terminal according to claim 2 further comprising the spring member mounted inside the terminal main body, the spring member including:
the upper basal plate portion and the lower basal plate portion;
a connecting plate portion connecting the upper basal plate portion and the lower basal plate portion together; and
an engagement portion provided at the connecting plate portion and arranged to engage with a locking portion of the terminal main body.

7. The terminal according to claim 2, wherein one projection and another projection which allow the insertion of the mating terminal are provided at a front end and a rear end of the terminal main body, wherein the one contact spring pieces and the other contact spring pieces project further inwardly than the one projection and the other projection.

8. The terminal according to claim 1, wherein the one contact spring pieces and the other contact spring pieces are arranged at opposing positions along a thickness direction of the upper wall and the lower wall.

9. The terminal according to claim 8 further comprising the spring member mounted inside the terminal main body, the spring member including:
the upper basal plate portion and the lower basal plate portion;
a connecting plate portion connecting the upper basal plate portion and the lower basal plate portion together; and
an engagement portion provided at the connecting plate portion and arranged to engage with a locking portion of the terminal main body.

10. The terminal according to claim 8, wherein one projection and another projection which allow the insertion of the mating terminal are provided at a front end and a rear end of the terminal main body, wherein the one contact spring pieces and the other contact spring pieces project further inwardly than the one projection and the other projection.

11. The terminal according to claim 1, wherein the one contact spring piece and the other contact spring piece are arranged alternatively in a staggered alignment along the mating terminal insertion direction.

12. The terminal according to claim 11 further comprising the spring member mounted inside the terminal main body, the spring member including:
the upper basal plate portion and the lower basal plate portion;
a connecting plate portion connecting the upper basal plate portion and the lower basal plate portion together; and
an engagement portion provided at the connecting plate portion and arranged to engage with a locking portion of the terminal main body.

13. The terminal according to claim 11, wherein one projection and another projection which allow the insertion of the mating terminal are provided at a front end and a rear end of the terminal main body, wherein the one contact spring pieces and the other contact spring pieces project further inwardly than the one projection and the other projection.

14. The terminal according to claim 1, wherein the one contact spring piece and the other contact spring piece are arranged at the same position in the mating terminal insertion direction while arranged alternatively in a staggered alignment in a width direction of the wall.

15. The terminal according to claim 14 further comprising the spring member mounted inside the terminal main body, the spring member including:
the upper basal plate portion and the lower basal plate portion;
a connecting plate portion connecting the upper basal plate portion and the lower basal plate portion together; and an engagement portion provided at the connecting plate portion and arranged to engage with a locking portion of the terminal main body.

16. The terminal according to claim 14, wherein one projection and another projection which allow the insertion of the mating terminal are provided at a front end and a rear end of the terminal main body, wherein the one contact spring pieces and the other contact spring pieces project further inwardly than the one projection and the other projection.

17. The terminal according to claim 1 further comprising the spring member mounted inside the terminal main body, the spring member including:

the upper basal plate portion and the lower basal plate portion;

a connecting plate portion connecting the upper basal plate portion and the lower basal plate portion together; and an engagement portion provided at the connecting plate portion and arranged to engage with a locking portion of the terminal main body.

18. The terminal according to claim 17, wherein the connecting plate portion is provided plurally such that the pair of the connecting plate portions is arranged at a front end and a rear end of the basal plate portion in the mating terminal insertion direction, respectively, a pair of engagement pieces, as the engagement portion, is arranged at a front end and a rear end of the respective pairs of connecting plate portions, respectively, and each of the pairs of engagement pieces engages with each of locking apertures as the locking portion.

19. The terminal according to claim 17, wherein one projection and-another projection which allow the insertion of the mating terminal are provided at a front end and a rear end of the terminal main body, wherein the one contact spring pieces and the other contact spring pieces project further inwardly than the one projection and the other projection.

20. The terminal according to claim 1, wherein one projection and another projection which allow the insertion of the mating terminal are provided at a front end and a rear end of the terminal main body, wherein the one contact spring pieces and the other contact spring pieces project further inwardly than the one projection and the other projection.

* * * * *